US007275728B1

(12) United States Patent
Branson

(10) Patent No.: US 7,275,728 B1
(45) Date of Patent: Oct. 2, 2007

(54) ACCESSORY HANGER

(76) Inventor: James Michael Branson, 14 Stonehenge La., East Northport, NY (US) 11731

( * ) Notice: Subject to any disclaimer, the term of this patent is extended or adjusted under 35 U.S.C. 154(b) by 43 days.

(21) Appl. No.: 11/273,662

(22) Filed: Nov. 14, 2005

(51) Int. Cl.
*A47H 1/16* (2006.01)

(52) U.S. Cl. ..... 248/302; 248/304

(58) Field of Classification Search ..... 248/302, 248/303, 304, 339, 340, 215
See application file for complete search history.

(56) References Cited

U.S. PATENT DOCUMENTS

| | | | | |
|---|---|---|---|---|
| 2,318,930 | A * | 5/1943 | Dietrich | 211/119 |
| 3,490,726 | A * | 1/1970 | Mills | 248/313 |
| 3,511,461 | A | 5/1970 | Clark | |
| 3,536,287 | A | 10/1970 | Kramer | |
| 3,789,996 | A * | 2/1974 | Stroh | 211/119 |
| 4,117,629 | A | 10/1978 | Ekdahl | |
| 4,301,767 | A | 11/1981 | Willinger et al. | |
| 4,415,137 | A | 11/1983 | Garves | |
| 4,524,542 | A | 6/1985 | Elliott | |
| 4,598,891 | A * | 7/1986 | Hanert | 248/340 |
| 4,666,115 | A | 5/1987 | Schiro | |
| 5,390,443 | A * | 2/1995 | Emalfarb et al. | 47/67 |
| D365,015 | S | 12/1995 | Avinger | |
| 5,553,823 | A * | 9/1996 | Protz, Jr. | 248/304 |
| 5,607,131 | A * | 3/1997 | Adams | 248/215 |
| 5,711,502 | A | 1/1998 | Emalfarb et al. | |
| 6,065,727 | A * | 5/2000 | Fitzgerald et al. | 248/302 |
| 6,398,174 | B1 | 6/2002 | Emalfarb et al. | |
| 2002/0000504 | A1 * | 1/2002 | Bayne | 248/302 |

* cited by examiner

*Primary Examiner*—Ramon O Ramirez
(74) *Attorney, Agent, or Firm*—Island Patent; F. S. Tiernd

(57) ABSTRACT

A one-piece slip-on accessory hanger includes an engaging and support portion, an extension portion, and an end portion, all of which are formed of an elongated rod member. The accessory hanger is formed by including a plurality of spaced bends, with each bend formed at a predetermined bend location, with a predetermined bend angle, and in a predetermined bend direction. Additionally, one or more fixing locations may be included for increasing the strength and rigidity of the accessory hanger. The accessory hanger is specifically structured for being slipped over and securely engaging an upper portion of a support structure such as a PVC fence, without the need for any fastening devices. This abstract is provided to comply with rules requiring an abstract, and is submitted with the intention that it will not be used to interpret or limit the scope and meaning of the claims.

17 Claims, 8 Drawing Sheets

ACCESSORY HANGER

TECHNICAL FIELD

The present invention relates most generally to devices for securely hanging items such as plants, suspended lanterns and or lighting fixtures, wind chimes, as well as a variety of other items. More particularly, the invention relates to a sturdy accessory hanger having a simple design and construction, which is securely slipped over and mounted upon a support structure without the use of fasteners such as nails, screws, bolts, and straps.

BACKGROUND

The use of plastic and polyvinyl chloride (PVC) material for manufacturing fencing and partition systems, and related products/items, has increased dramatically in recent years. As the quality of these products has increased, more and more individuals are opting for these long life, low maintenance products.

Traditional fences and partitions, of a variety of designs and constructions, have long been utilized for displaying hanging plants, lanterns, and other known items. In the past, an accessory hanger of need would simply be fastened to a wooden, metal, or chain link fence or partition using nails, screws, bolts, and or a variety of strapping means. However with the cost of available PVC fence and partition systems still being quite high, and their purchase essentially justified by very long life and low maintenance, owners do not want to have to drill and screw into these plastic/PVC structures. As such, the commonly used and available accessory hangers that are known in the prior art are generally not considered acceptable for use with plastic and PVC fences and partitions.

Accordingly, it would be most desirable to provide an improved accessory hanger having a simple and low cost structure that can attach to a fence or partition by simply being slipped over/upon one or more structures thereof, effecting a secure mounting thereupon without employing mechanical fasteners or strapping materials. A number of other characteristics, advantages, and or associated novel features of the present invention, will become clear from the description and figures provided herein. Attention is called to the fact, however, that the drawings are illustrative only. In particular, the embodiments included and described, have been chosen in order to best explain the principles, features, and characteristics of the invention, and its practical application, to thereby enable skilled persons to best utilize the invention and a wide variety of embodiments providable that are based on these principles, features, and characteristics. Accordingly, all equivalent variations possible are contemplated as being part of the invention, limited only by the scope of the appended claims.

SUMMARY OF THE INVENTION

In accordance with the present invention, a preferably one-piece slip-on or slip over accessory hanger is provided that includes an engaging and support portion, an extension portion, and an end portion. Each portion of the one-piece accessory hanger is formed of an elongated rod member by providing a plurality of bends that are each formed at a predetermined bend location, with a predetermined bend angle, and in a predetermined bend direction. Additionally, one or more fixing locations may be included that preferably provide for an increasing of the rigidity and or strength of the accessory hanger. As will be discussed in greater detail hereinafter, each fixing location is most preferably provided at a location wherein at least two portions of the elongated rod member are contacting (e.g., crossing or touching) as a result of forming a plurality of bends in the elongated rod member.

It is important to note that the structure of the present invention is such that the accessory hanger, and in particular, the engaging and support portion, are configured to be slipped over and engage an upper portion of a support structure such as a partition system, in a secure manner, without any need for additional fastening means.

BRIEF DESCRIPTION OF THE DRAWINGS

In the drawings, like elements are assigned like reference numerals and designations. The drawings are not necessarily to scale, with the emphasis instead placed upon the principles of the present invention. Additionally, each of the embodiments depicted are but one of a number of possible arrangements utilizing the fundamental concepts and features of the present invention. The drawings are briefly described as follows.

PARTIAL LIST OF REFERENCE NUMERALS

| | |
|---|---|
| 10, 10a, 10b | slip-on accessory hanger embodiments |
| 12 | elongated rod member |
| 12-1 | first end of 12 |
| 12-2 | second end of 12 |
| 12a-12h | predetermined segment lengths of 12 |
| 14 | bend location |

-continued

| | |
|---|---|
| 20 | (slip-over) engaging and support portion |
| 24 | fixing location |
| 24a | weld |
| 24b | wire strap/loop |
| 30 | extension portion |
| 30a | first end of 30 |
| 30b | second end of 30 |
| 40 | end portion |
| 60 | Partition system (support structure) |
| 62 | post |
| 62a | post cap |
| 64 | partition portion |
| 70 | item being supported |
| 70a | hanging plant |
| 70b | hanging lantern |
| 78 | ground surface |

DETAILED DESCRIPTION OF EMBODIMENTS OF THE INVENTION

It is important to establish the definition of several descriptive terms and expressions that will be used throughout this disclosure. The term 'support structure' may be assumed to be any suitable structure in accordance with the descriptions and structures of the present invention provided herein, and may certainly include common partition systems including fences and partitions formed of wood and PVC materials. Additionally, a support structure may include a variety of partition and privacy providing arrangements formed of concrete, stone, brick, etc. The term 'accessory item' may be assumed to include a wide variety of items that may be hung or suspended, including for example, hanging plant containers, lanterns, lights, bug eradication devices, wind chimes, etc. The term 'elongated rod member' may most preferably be provided by a single monolithic rod member provided as a metal or other material having suitable bendability, malleability, and or ductility, as required by the respective embodiment and the associated structure thereof. It should be noted that an elongated rod member may also be provided as an 'elongated construction' possibly provided by several preferably overlapping lengths that are fixed together to form the elongated rod member. Other important terms and definitions will be provided, as they are needed, to properly define the present invention and its associated novel characteristics and features.

Figure 1:
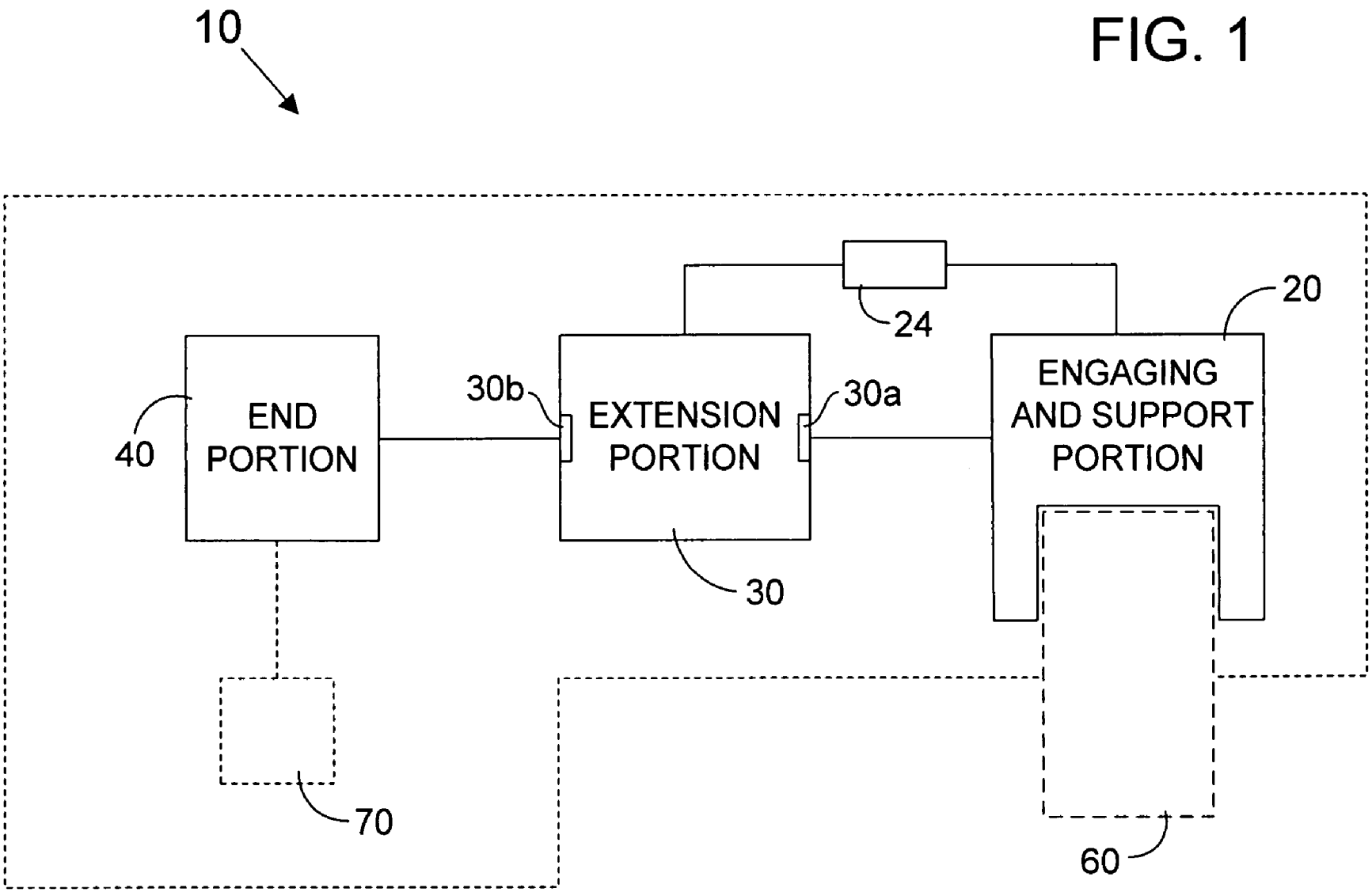
FIG. 1 provides a high level block diagram of a generalized preferred embodiment of the accessory hanger of the present invention.

Referring now to the drawings, FIG. 1 provides a high level block diagram of a most generalized preferred embodiment of a slip-on accessory hanger 10 of the present invention. As shown, the accessory hanger 10 includes an engaging and support portion 20, an extension portion 30, and an end portion 40. Also included is at least one fixing location 24. The most preferred embodiments of the invention involve the use of a single elongated rod member 12, which is formed from a single piece a suitable material with a first end and a second end. It may be noted that the elongated rod member of the present invention may be solid or hollow (tube like). In addition, the elongated rod member may be constructed of a plurality of fixed (e.g., welded) portions, which collectively provide the overall length of the elongated rod member, while still having a first end and a second end.

As shown in FIG. 1, the engaging and support portion 20 is configured to be slipped over and engage an upper portion of a partition system 60, in a secure manner—without the need for additional fastening means. For example, embodiments may be provided to slip over and engage support posts, as well as partition portions, of a partition system. The extension portion 30 preferably is provided having a first end 30*a* and a second end 30*b*. The first end 30*a* is coupled to, and proximate the engaging and support portion 20, and further arranged such that the second end 30*b* extends outwardly (from the engaging and support portion 20). It may be noted that the term 'coupled to', when referring to the first end 30*a* extension portion 30 may be effected by forming both the engaging and support portion and the extension portion from an elongated rod member 12, for example a common ⅜" or ½" metal rod, wherein the extension portion 30 flows outwardly from the engaging and support portion 20, beginning at a bend 14. The end portion 40 is preferably formed at or proximate to the second end 30*b* of the extension portion 30. As such, the end portion 40 is physically spaced outwardly, and extended from, the engaging and support portion 20 and the portion of the partition system to which the accessory hanger is placed upon and engaging. Importantly, preferred embodiments of the end portion 40 are structured for enabling at least one item 70 to be securely hung and suspended from the accessory hanger 10 (at the end portion 40).

Each included fixing location 24, which will be discussed in greater detail hereinafter, is preferably included to increase the strength and rigidity of the accessory hanger 10. Further, each fixing location 24 is not provided to couple or fix two otherwise separate and individual elongated rod member portions. In deed, as will be seen and discussed hereinafter, each fixing location 24 is most preferably provided at a location wherein at least two portions of the elongated rod member 12 are contacting (e.g., crossing and or touching) as a result of forming of a plurality of spaced 'bends'.

Accordingly, an important aspect of the present invention, which is provided with each of the most preferred embodiments disclosed herein, calls for each of the engaging and support portion 20, the extension portion 30, and the end portion 40 to be constructed of an elongated rod member 12 having a plurality of spaced bends provided there along, wherein each bend is formed at a predetermined bend location 14, with a predetermined bend angle, and in a predetermined bend direction.

Figure 2:
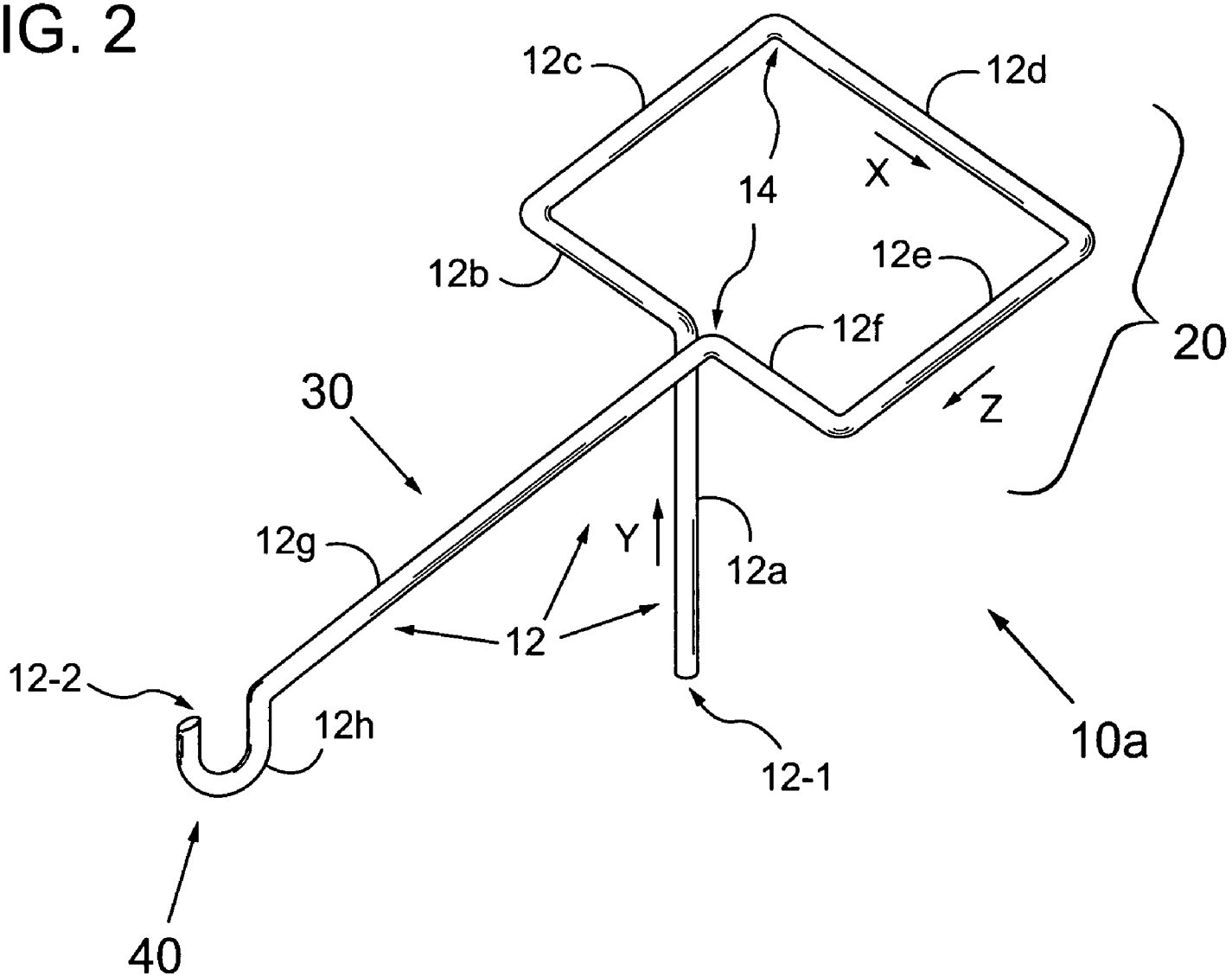
FIG. 2 depicts a first preferred embodiment of the invention structured for being slipped over a support structure, such as a vertical support post of a fence or partition system.

Turning now to FIG. 2, a first preferred embodiment of a accessory hanger 10*a* the present invention is illustrated. As shown, this embodiment is preferably formed of a single piece of elongated rod member 12, which may be considered as being comprised of a plurality of portions that may be termed 'segment lengths'. The segment lengths shown in FIG. 2 may be assumed to start at a first end 12-1, and include segment lengths 12*a*, 12*b*, and continue through to 12*h*. A second end of segment 12*h* is also termed the second end 12-2 of the elongated rod member 12. As depicted in FIG. 2, and also clearly shown in FIG. 3A, the engaging and support portion 20 is formed of a plurality of segment lengths including 12*a*, 12*b*, 12*c*, 12*d*, 12*e*, and 12*f*. Note also that each segment length is coupled to the next segment length at and or via a bend location. As such, the structure of the embodiment 10*a* depicted in FIG. 2 may be realized by one elongated rod member 12, having a plurality of bends 14 formed at predetermined bend locations, each having a predetermined bend angle, and provided in a predetermined bend direction. Further, the preferred embodiment of FIG. 2 may include a fixing location proximate to the bend between segments 12*a* and 12*b*, and the bend between 12*f* and 12*g*. Fixing locations will be discussed in greater detail when referring to FIGS. 3A, 3B, and 3C. Also clearly shown in FIG. 2 is the extended portion 30, provided by segment length 12*g* and the end portion 40, formed of a u-shaped 12*h* segment length.

Returning again to FIG. 2, it may be noted that a most preferred embodiment of the invention, for example for use with partition systems such as a fencing structure of PVC materials, may be structured with virtually all bends 14 provided at an angle of substantially 90 degrees. To be clear, it may be assumed that the bends 14, which may be equivalently termed 'right angle' bends for this embodiment, may be assumed to each provide a bend 14 of preferably 90 degrees, +/−2 or 3 degrees. In addition, each bend 14 will be made substantially in one of three predetermined bend directions, with each possible bend direction preferably being orthogonal to the other two. Accordingly, a most preferred embodiment of a accessory hanger 10 of the invention may be provided having segment lengths that are each (simultaneously) alignable with one of an x-axis, a y-axis, or a z-axis, say of a Cartesian axis arrangement (see FIG. 2).

Figure 3B:
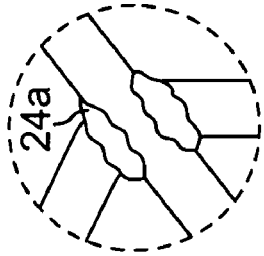
FIGS. 3B and 3C provide examples of most preferred arrangements for providing one or more fixing locations, added for improving strength and rigidity of preferred embodiments of the accessory hanger of the invention.
Figure 3C:
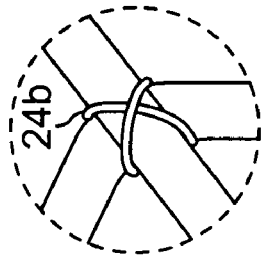
Figure 3A:
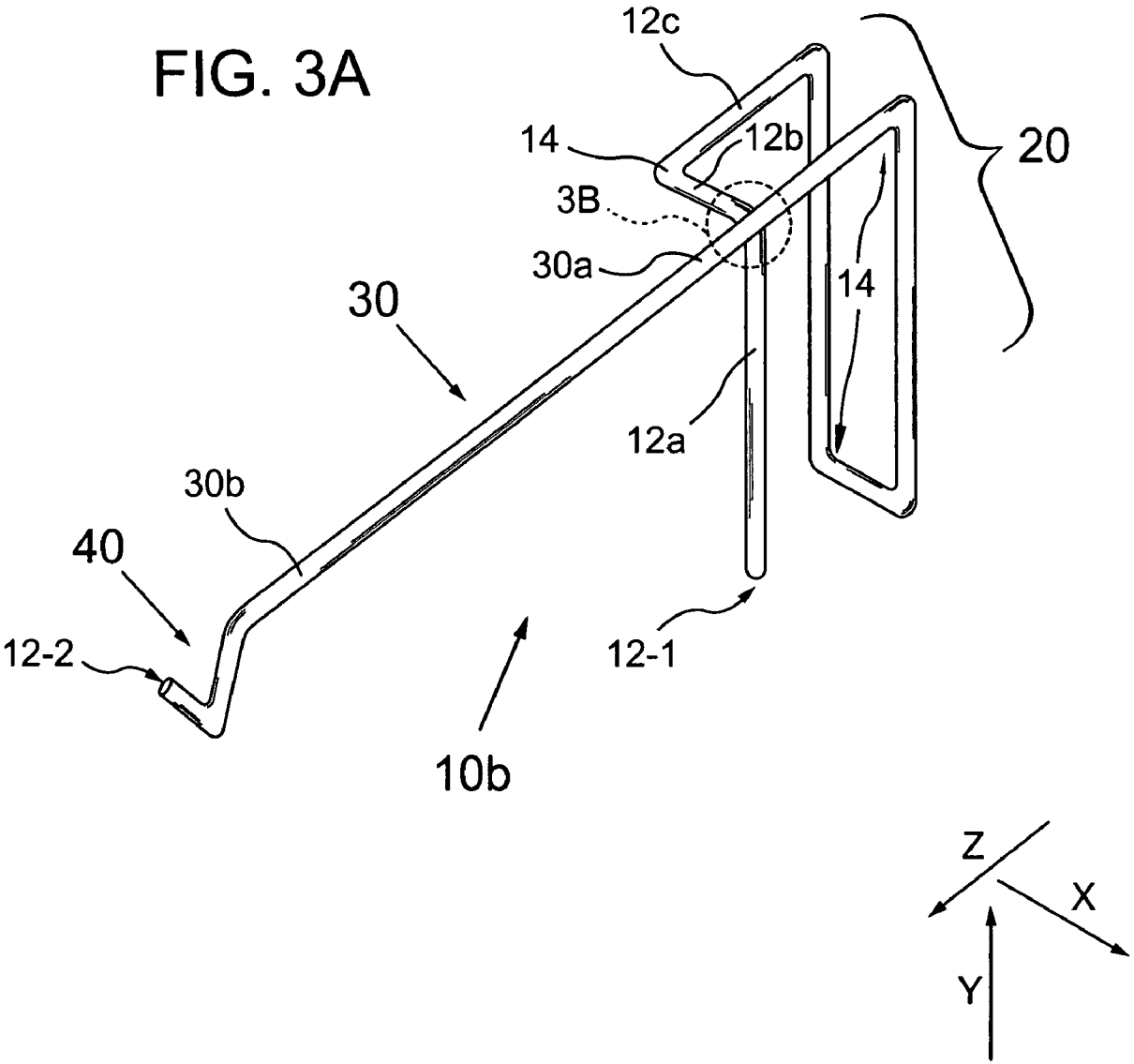
FIG. 3A shows a second preferred embodiment of the invention structured for being slipped over a fence or partition section of a partition system.
Figure 4:
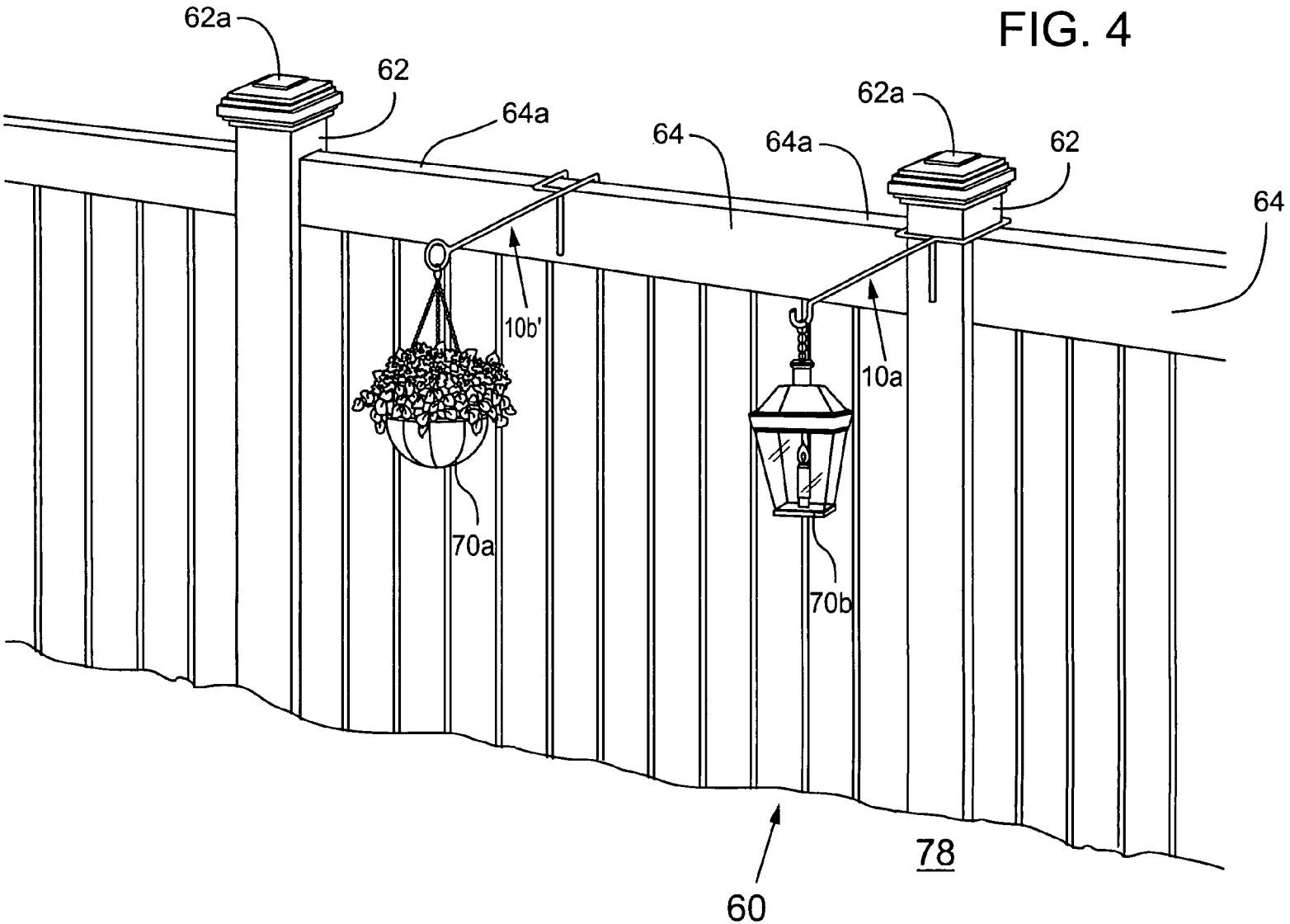
FIG. 4 is a perspective view of a portion of a partition system clearly showing several preferred embodiments, such as those of FIGS. 2 and 3, after being slipped over and installed upon respective portions of the partition system.

Referring now to FIG. 3A, there is depicted another most preferred embodiment of an accessory hanger 10*b* of the invention. As shown, the accessory hanger 10*b* is again formed of an elongated rod member 12 structured with a first end 12-1 and a second end 12-2. The elongated rod member 12 is again arranged having a plurality of bends 14, formed at predetermined bend locations, each with a predetermined bend angle and a predetermined bend direction. As with previous embodiments, the accessory hanger 10*b* is structured with an engaging and support portion 20, an extension portion 30, and an end portion 40. It may be further noted that the preferred example embodiments depicted in FIG. 2 and FIG. 3A, are clearly structured and intended to be slipped over a post-like structure and an upper partition portion, respectively. Each of these mounting arrangements, wherein accessory hangers 10*a* and 10*b* are slipped over and engaging partition system portions, are illustrated in FIG. 4. In addition, a first segment length 12*a* of each embodiment, which is located at the first end 12-1 of the elongated rod member 12, is adapted to provide a simple structure that still provides for a secure supporting and engaging to the post/partition portion—without the need for additional fasteners.

Figure 7:
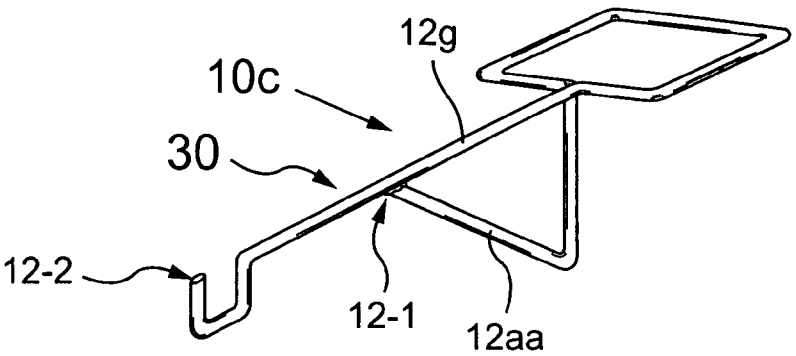
FIG. 7 illustrates yet another preferred embodiment of the invention, depicted having a plurality of fixing locations.

Returning to FIG. 3A, and as best seen in FIGS. 3B and 3C, at least one fixing location 24 is most preferably included with preferred embodiments of the invention. It should be noted that fixing location 24 may be provided in many equivalent functional versions. For example, as shown in FIG. 3B, a simple weld 24*a* may be employed. Alternately, as depicted in FIG. 3C, a wrapped strapping arrangement, for example including a tie material such as wire strap 24*b* may be employed. It should further be noted that when a suitable fixing location 24 is included, a physical altering of the contacting portions of the elongated rod member 12, typically at or very proximate to at least one bend location, may be desired. For example, a portion of the diameter of the elongated rod member 12 may be reduced, altered, or filed down. What may be considered most critical is that at each fixing location 24, for example proximate to where the first end 30*a* of the extension portion 30 contacts a bend location between segment lengths 12*a* and 12*b*, the contacting portions are rigidly fixed, causing an increasing of strength and rigidity of the accessory hanger 10. FIG. 7 provides an example of an embodiment of the accessory hanger having two fixing locations 24, with a second included fixing location 24 provided at the end 12-1 of the elongated rod member 12.

Turning now to FIG. 4, there is illustrated therein a partition system 60, such as that provided by a PVC fence structure. Included are posts 62, with each arranged having a post cap 62*a*. The posts 62 support and hold upright each partition portion 64. As can be seen, if a post cap 62*a* is removed, the accessory hanger 10*a* may be installed by being slipped over the top of the post 62, and letting the accessory hanger 10*a* rest upon a top surface of two juxtaposed partition portions 64. Once slipped over and engaging the post 62, the cap 62*a* may typically be re-installed without any physical modification being required. Similarly, accessory hanger 10*b*' may be slipped over the top edge 64*a* of a partition portion 64, and quickly and securely installed thereupon (as seen in FIG. 4).

As clearly indicated in FIG. 4, embodiments of the accessory hanger 10 may be configured for engaging a variety of structures, by simply being slipped upon an upper portion of such a structure. For example, as indicated hereinabove, it is certainly contemplated that such structures may include common PVC fences. It may be further noted that some support structures, such as a single vertical post 62, not employed for supporting partition portions 64, may require 'stops' or a size-reducing 'step' to be provided proximate to a top end of the post, to assist in suitably engaging a accessory hanger 10 to a support structure of interest.

Referring once again to FIGS. 2, 3A, and 4, it should be noted that the end portion 40 of preferred embodiments may be provided in a variety of configurations. For example, the end portion 40 may be provided by a downwardly extending, U-shaped portion (FIG. 2) or V-shaped portion (FIG. 3A). In each case the end portion 40 may be formed quite proximate to the second end 12-2 of the elongated rod member 12. Similarly, as shown in FIG. 4, the end portion 40 may be provided as a substantially closed loop (see embodiment 10*b*'). Skilled persons may certainly provide other possible configurations for the end portion 40—including a number that are substantially more complex than those depicted herein. In all cases the end portion 40 is arranged to support items such as hanging plants 70*a*, hanging lanterns 70*b*, as well as a variety of other common and known items.

As shown in FIGS. 2 and 4, embodiments of the engaging and support portion 20 may be substantially provided by a substantially rectangular loop portion having a plurality of flattened segment lengths and a plurality of 90 degree bend locations at the end of each flattened side. Importantly, should the accessory hanger 10 of the invention need to be installed upon a post not having a rectangular or square cross section, bend angles other than 90 degrees may be employed.

Figure 5:
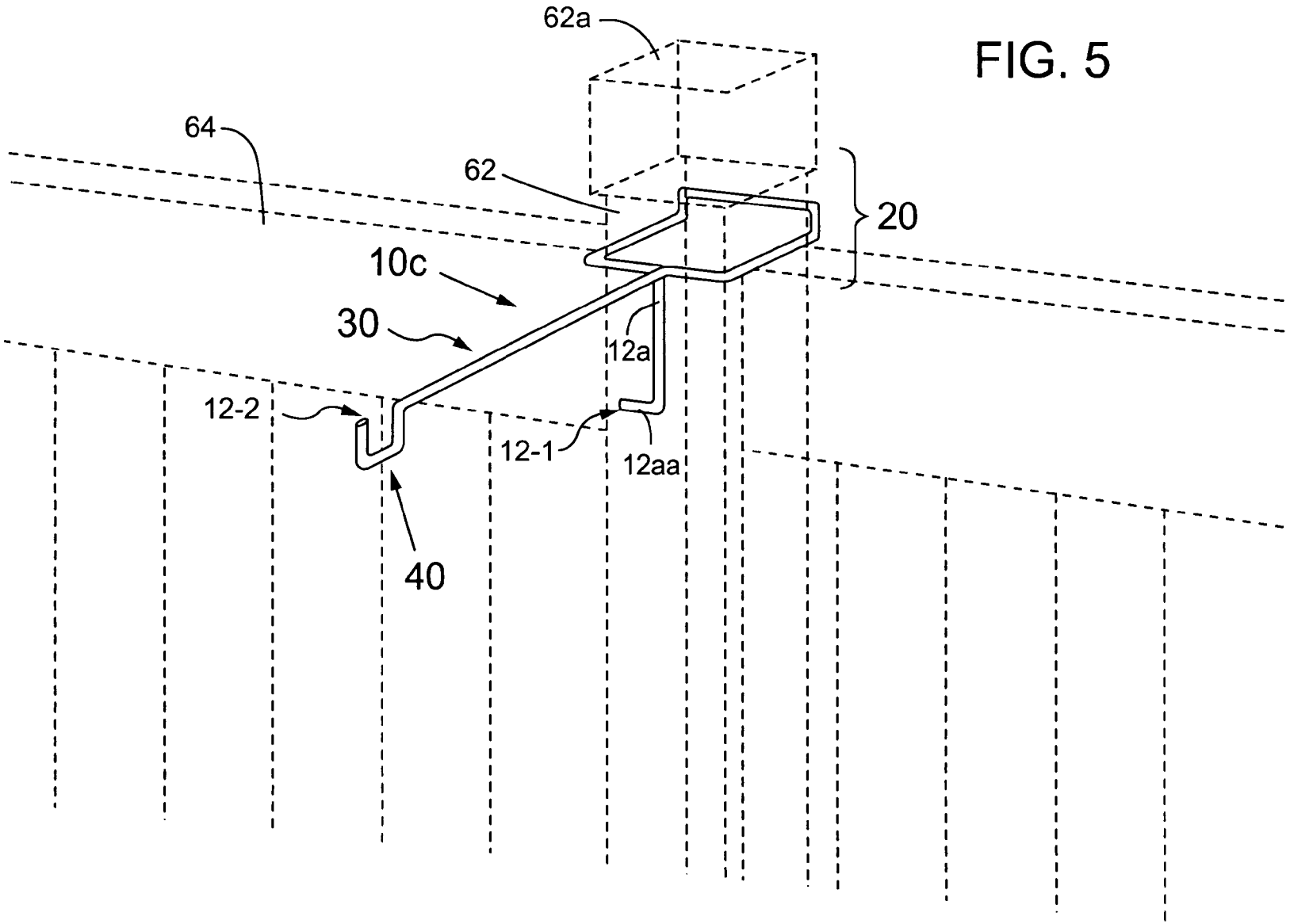
FIG. 5 illustrates yet another preferred embodiment of the invention installed upon a support post of a partition system.

It is important to understand that the embodiments depicted in FIGS. 2, 3A, and 4, are simple structures illustrating important features of the most preferred embodiments of the present invention. It is certainly contemplated that other and more complicated embodiments are possible. For example, as shown in FIG. 5, yet another embodiment of the accessory hanger 10*c* is illustrated. As shown, the engaging and support portion 20 is provided with several additional bends 14, formed proximate to the rear or outside face of post 62. Another feature that may be included with embodiments of the present invention is provided proximate to the first end 12-1 of the elongated rod member 12. As can be clearly seen in FIG. 5, this feature includes an additional bend at the end of segment length 12*a*, providing a short horizontal extension 12*aa*. Such an additional feature provides for an increasing of the surface area over which the first end 12-1 distributes a loading force when the accessory hanger 10*c* is employed to suspend and support a hanging item. Another example of a modified segment length 12*a* may be to form a 12*a* with a series of opposing curves (say forming an elongated 's' or other decorative shapes).

Figure 6A:
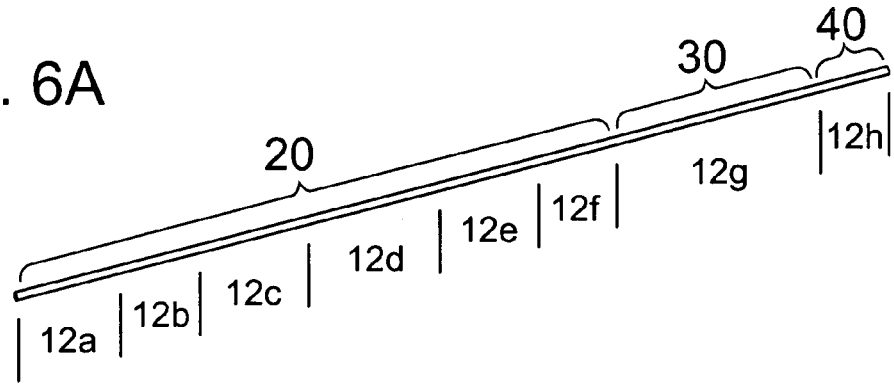
FIGS. 6A through 6G depict one possible sequence for establishing a plurality of bends, with each bend formed at a predetermined bend location, with a predetermined bend angle, and in a predetermined bend direction.
Figure 6B:
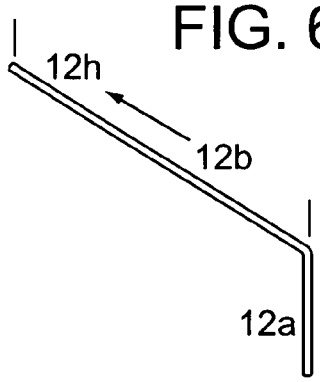
Figure 6C:
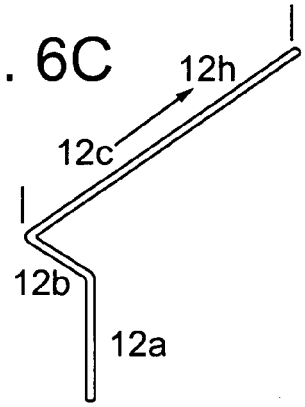
Figure 6D:
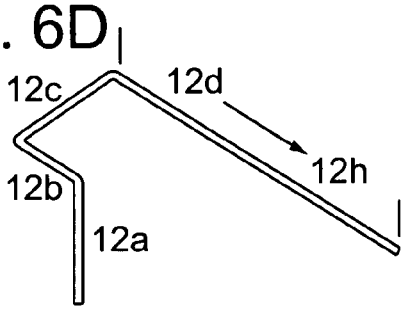
Figure 6E:
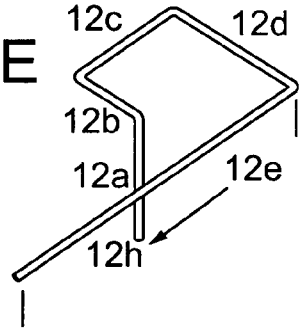
Figure 6F:
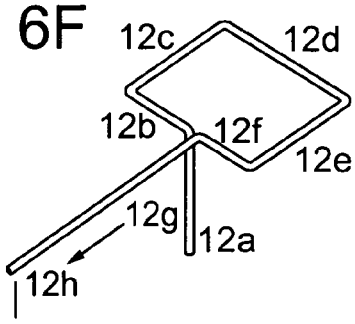
Figure 6G:
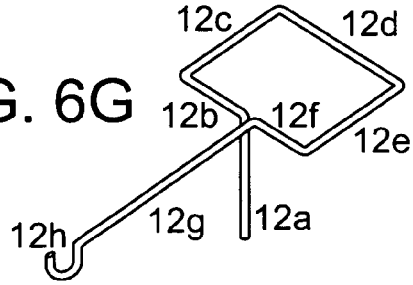

Turning now to FIGS. 6A through 6G, the substantial forming of an embodiment of a accessory hanger of the present invention will be presented. As shown in FIG. 6A, a length of elongated rod member 12, comprising segment lengths 12*a* through 12*h* is provided. Further, the engaging and support portion 20 will be formed of segment lengths 12*a*-12*f*, with the extension portion 30 provided by segment length 12*g*, and the end portion 40 formed by segment length 12*h*. As shown in FIG. 6B, a possibly first bend location is formed between segment lengths 12*a* and 12*b*—thereby defining 12*a* and 12*b*. It should be understood that 12*a* and 12*b* may be termed 'coupled' or 'coupled together' at bend 14. In FIG. 6C, a second bend location is established between segment lengths 12*b* and 12*c*. This second bend location is formed at a predetermined distance from the first bend location, defining the actual length of segment length 12*b*. The process continues, as shown in FIGS. 6D, 6E, 6F, and 6G. Once a plurality of bends 14 are formed, each at a predetermined bend location, having a predetermined bend angle provided in a predetermined bend direction, any included fixing locations may be provided. This process and method of forming an accessory hanger 10 of the invention will be further discussed hereinafter when referring to FIG. 9. It may be noted that the series of bends 14 depicted in FIGS. 6A through 6G, may be altered in order to provide other contemplated embodiments, in addition to those depicted in FIGS. 3A, 4, and 5. As understood by skilled persons, yet other modifications may certainly be provided for improving the form and function of the accessory hangers of the present invention. For example, as depicted in FIG. 7, segment length 12*a* may be arranged to extend upwardly, at an angle, with first end 12-1 fixed to a mid-length location along segment length 12*g*.

Figure 8B:
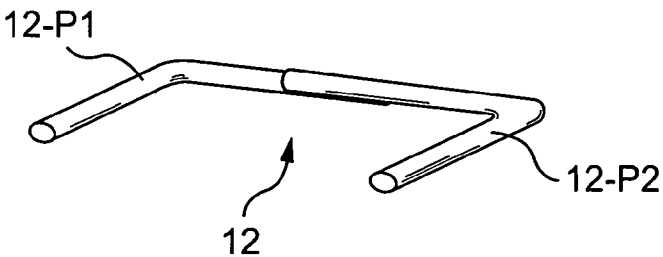
FIGS. 8A and 8B provide examples of overlapping couplings effected between a first elongated rod portion and a second elongated rod portion, which provide a portion of an elongated rod member.
Figure 8A:
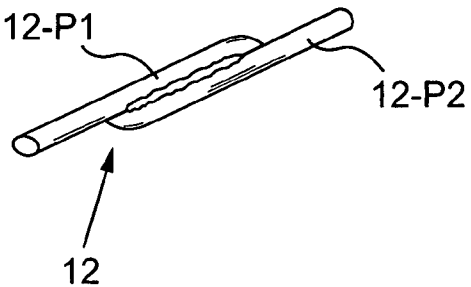

Turning briefly to FIGS. 8A and 8B, there is depicted therein several possible arrangements of discreet portions, which may comprise an elongated rod member that is not formed of a single monolithic length of rod material. As shown in FIG. 8A, an end of a first portion 12-P1 and an end of a second portion 12-P2 may be overlapped and fixed (e.g., welded) together to form a longer elongated rod member 12. This arrangement may also be termed an 'elongated construction'. A similar fixing arrangement is shown in FIG. 8B provided along a back segment length of, for example, the engaging and support portion 20. It is important to note that the coupling provided by fixing preferably overlapping portions is not the same as a fixing location 24, such as depicted in FIGS. 3B and 3C. Further, the couplings of FIGS. 8A and 8B may be formed after one or more bends 14 are effected at predetermined bend locations along one or more discrete portions of an elongated rod member 12.

Figure 9:
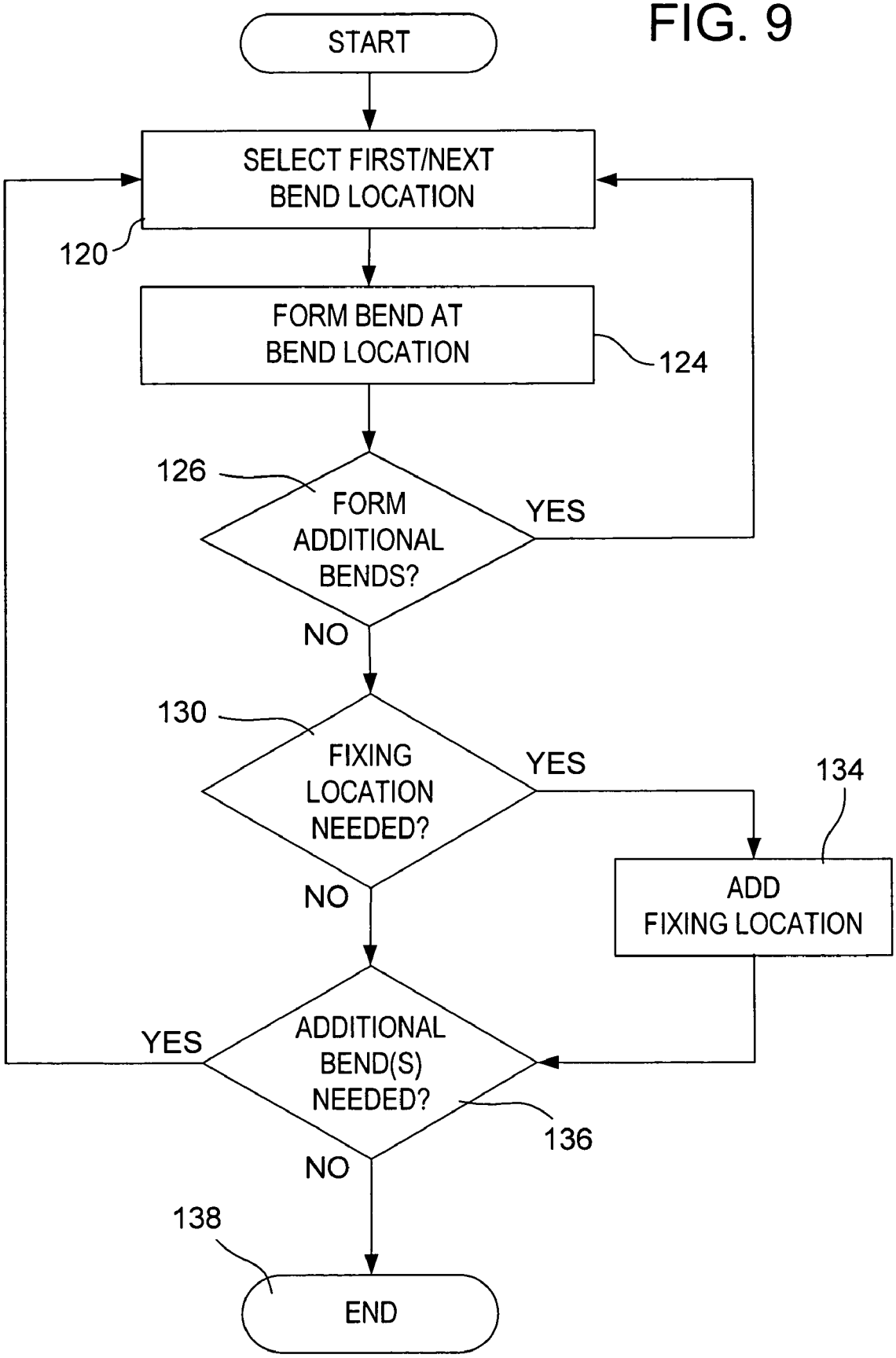
FIG. 9 provides a high level flowchart of a basic method of constructing an accessory hanger in accordance with the present invention.

Referring now to FIG. 9, a preferred method of forming a one piece slip-on accessory hanger 10 of the invention will be presented. The method may commence at 120, with a selecting of a first bend location along a length of an elongated rod member. At 124 a bend is formed at the selected and predetermined bend location. It may be noted that each bend is also made in a predetermined bend direction (e.g., in one of an x, y, or z direction). This first bend location, as well as others to be selected subsequently, may most preferably be established by measuring a predetermined distance from one of a first end or a second end of at least a portion of the elongated rod member. As skilled persons will appreciate, bend locations, bend angles, and bend directions may certainly be defined in may ways, which may range from a programmed or database approach that may be employed with a bending machine, or other more manual arrangements.

Referring again to FIG. 9, at 126, an assessment is made to determine if one or more bends are required. If yes, at 120 a next bend location is determined. The next predetermined bend location may be established as being spaced from one of the first bend location (described hereinabove), as spaced from another bend formed after the first bend, or as spaced from an end of a portion of the elongated rod member. Once the bend location is located, a bend is formed—at a predetermined bend angle and in a predetermined bend direction. These activities may continue, with a repeating of 120, 124, and 126, until all bends are completed or until it is determined at 130 that a fixing location is to be added. When at least one fixing location is required, each is effected at 134. At 136, a determination of whether additional bends are required is made, with a continuing at 120 if more bends are to be formed. If at 136 is it determined that no additional bends are required, and additionally no fixing locations are needed (not explicitly illustrated in the simplified method of FIG. 9), the method for forming the accessory hanger may end at 138.

As understood by skilled persons, the method of FIG. 9 may be considered a simplified version of methods that may be employed. Importantly, methods of the invention will provide for forming some sequence of bends, at predetermined bend locations, and at predetermined bend angles, and in predetermined bend directions. Additionally one or more fixing locations may be included and effected after some and or all bends have been formed.

While there have been described herein a plurality of the currently preferred embodiments of the methods and means of the present invention, those skilled in the art will recognize that other and further modifications may be made without departing from the invention. For example, embodiments of the engaging and support portion 20 need not be rectangular as depicted in FIGS. 2 and 4, and may be provided in a number of other shapes, possibly including a hexagonal or octagonal. Further the extension portion 30 may be provided at a downward angle with respect to the engaging and support portion 20. Alternately the extension portion 20 may be curved downwardly (not illustrated) such that the end portion 40 is situated below the engaging and support portion 20 when slipped over and engaging a portion of the support structure. As such, the foregoing descriptions of the specific embodiments of the present invention have been provided for the purposes of illustration, description, and enablement. They are not intended to be exhaustive or to limit the invention to the specific forms disclosed and or illustrated. Obviously numerous modifications and alterations are possible in light of the above teachings, and it is fully intended to claim all modifications and variations that fall within the scope of the appended claims provided hereinafter.

What is claimed is:

1. A slip-on accessory hanger, comprising:

a) an engaging and support portion that is structured for being slipped over and engaging an upper portion of a support structure;

b) an end portion that is spaced from the engaging and support portion, and structured for enabling an item to be hung and suspended from the accessory hanger at the end portion; and c) an extension portion having a first end coupled to the engaging and support portion and extending outwardly therefrom, and a second end coupled to the end portion;

d) wherein each of the engaging and support portion, the extension portion, and the end portion are formed constructed of single length of an elongated rod member having a plurality of bends provided at predetermined bend locations along the length of the elongated rod member, and further including at least one fixing location wherein at least two locations along the elongated rod member, which due to included bends, are contacting and rigidly fixed together at the fixing location;

e) with the fixing location provided proximate to the first end of the extension portion.

2. The slip-on accessory hanger in accordance with claim 1 wherein only a single fixing location is provided, with the fixing location being located proximate to a bend location and the first end of the extension portion, proximate to where the extension portion begins, and extends outwardly away from the engaging and support portion of the accessory hanger.

3. The slip-on accessory hanger in accordance with claim 1, wherein the engaging and support portion is structured for being slipped over a support structure that includes at least one of:

a) a partition section, wherein the engaging and support portion is substantially u-shaped;

b) a post supporting at least one partition section, wherein the engaging and support portion is provided as a substantially rectangular frame, formed by a portion of the elongated rod member proximate to at least six bends.

4. The slip-on accessory hanger in accordance with claim 1, wherein the engaging and support portion is provided as a substantially rectangular frame, formed by a portion of the elongated rod member proximate to the first end of the elongated rod member.

5. The slip-on accessory hanger in accordance with claim 1, wherein all bends provided at bend locations of the engaging and support portion, and the extension portion, are provided as substantially 90 degree bends, with each bend made in a pre-determined bend direction that is one of along an x-axis, a y-axis, or a z-axis.

6. The slip-on accessory hanger in accordance with claim 1, wherein the end portion formed at the second end of the elongated rod member is provided as at least one of:

a) a curved, downwardly extending, u-shaped portion;

b) a downwardly extending, V-shaped portion; and c) a substantially closed loop.

7. The slip-on accessory hanger in accordance with claim 6, wherein a segment length of the elongated rod member, at the first end thereof, extends downwardly from the engaging and support portion proximate to a fixing location, for providing additional strength and rigidity when supporting items hung from the end portion when the accessory hanger is slipped over and engaging the support structure.

8. A one piece slip-on accessory hanger structured for being slipped over and engaging a support structure and subsequently being available for supporting at least one item being hung and suspended from the accessory hanger, the accessory hanger comprising:

a) an engaging and support portion formed of a first plurality of segment lengths of an elongated rod member, with each segment length having a predetermined length and having a bend location provided at an end of a segment length, such that the engaging and support portion is structured for being slipped over and engaging an upper portion of a support structure;

b) an extension portion having a first end and a second end, and formed of at least one additional segment length of the elongated rod member, with the first end starting at a bend at the end of a segment length of the engaging and support portion, and extending outwardly therefrom;

c) an end portion that is spaced from the engaging and support portion, and formed at the second end of the elongated rod member, and proximate to the second end of the extension portion;

d) wherein the engaging and support portion, the extension portion, and the end portion of the accessory hanger are each formed of a single length of an elongated rod member, with a plurality of bends provided at each of a sequence of spaced and pre-defined bend locations, with each bend made in a predetermined bend direction, and having a predetermined bend angle;

e) at least one fixing location provided at a location wherein, due to a plurality of the bends, at least two portions of the elongated rod member are contacting and rigidly fixed together, with the fixing location included for causing an increasing of strength and rigidity of the accessory hanger.

9. The slip-on accessory hanger in accordance with claim 8, wherein all bends provided at bend locations of the engaging and support portion are provided as substantially 90 degree bends.

10. The slip-on accessory hanger in accordance with claim 9, wherein only a single fixing location is provided proximate to a bend location at which the extension portion extends substantially horizontally and outwardly, away from the engaging and support portion of the accessory hanger.

11. The slip-on accessory hanger in accordance with claim 9, wherein each included fixing location includes at least one of:

a) a weld; and b) at least one wrap of a tie material, wrapped around the two overlapping and contacting locations of the elongated rod member.

12. The slip-on accessory hanger in accordance with claim 9, wherein the engaging and support portion is formed as one of:

a) a rectangular loop portion having a plurality of flattened sides and a plurality of 90 degree bend locations provided at the end of each flattened side; and b) a downwardly extending unshaped configuration having at least three segment lengths with a horizontal orientation, with one segment length being provided proximate to a first end of the elongated rod member.

13. The slip-on accessory hanger in accordance with claim 9, wherein the end portion, which is formed at a second end of the extension portion and the second end of the elongated rod member, is provided by at least one of:

a) a curved and downwardly extending u-shaped portion;

b) a downwardly extending v-shaped portion; and c) a closed loop having a small gap therein.

14. A method of constructing a one piece slip-on accessory hanger from an elongated rod member, with the accessory hanger configured for being slipped over and engaging an upper portion of a support structure enabling accessory items to be suspended therefrom in an extended fashion, the method comprising the steps of:

a) selecting a first bend location, established at a predetermined distance from one of a first end and a second end of at least a portion of an elongated rod member;

b) forming a first bend, at the first predetermined bend location, at a predetermined bend angle and in a predetermined bend direction, with the bend formed proximate to the end of a segment length representing a portion of the elongated rod member;

c) selecting a next predetermined bend location, spaced from one of:

i) a bend location of a previously completed bend;

ii) the first end of the elongated rod member; and iii) the second end of the elongated rod member;

d) forming an additional bend, at the predetermined bend location, at a predetermined bend angle and in a predetermined bend direction;

e) continuing with steps c) and d) until all bends have been made;

f) providing a fixing location at a location proximate to at least one bend location and where two contacting portions of the elongated rod member are fixed together for improving the strength and rigidity of the accessory hanger.

15. The method as recited in claim 14, wherein the steps for providing the bends at bend locations results in a plurality of bends having a bend angle of substantially 90 degrees.

16. The method as recited in claim 14, wherein the bend formed at step-b, and all other included bends formed at step d, which are included for forming the engaging and support portion, and the extension portion, are each provided such that the plurality of segment lengths thereof are arranged having an orientation along one of an x-axis, a y-axis, or a z-axis.

17. The method as recited in claim 16, wherein at the completion of the method, with all included bends having been formed at predetermined bend locations, and all fixing locations completed, the accessory hanger is substantially formed and rigidly structured having each of:

a) an engaging and support portion;

b) an extension portion; and c) an end portion.

* * * * *